US005649357A

United States Patent [19]

Chapman et al.

[11] Patent Number: 5,649,357

[45] Date of Patent: Jul. 22, 1997

[54] METHOD AND APPARATUS FOR ATTACHING CONNECTORS

[75] Inventors: James Stephen Chapman; Lyndon Dee Ensz, both of Omaha, Nebr.; Alan Howard Kirchner, Mount Holly; Clyde Allyn Lawrence, Flemington, both of N.J.; Ivan Pawlenko, Holland, Pa.; Geri Estelle Smith, Omaha, Nebr.

[73] Assignee: Lucent Technologies Inc., Murray Hill, N.J.

[21] Appl. No.: 455,950

[22] Filed: May 31, 1995

[51] Int. Cl.[6] ..... H01R 43/04

[52] U.S. Cl. ..... 29/861; 29/865; 29/750

[58] Field of Search ..... 29/749–752, 755, 29/861–863, 865, 866, 867; 439/312, 321

[56] References Cited

U.S. PATENT DOCUMENTS

| | | | |
|---|---|---|---|
| 3,997,956 | 12/1976 | McKee | 29/203 MW |
| 3,999,270 | 12/1976 | Witte | 29/203 MW |
| 4,020,540 | 5/1977 | Casciotti et al. | 29/753 |
| 4,047,294 | 9/1977 | Quigley | 29/749 |
| 4,048,711 | 9/1977 | Haller | 29/566.3 |
| 4,109,370 | 8/1978 | Quigley | 29/566.3 |
| 4,384,402 | 5/1983 | Petree | 29/749 |
| 4,820,184 | 4/1989 | Brandes | 439/321 |
| 4,825,530 | 5/1989 | Komuro | 29/749 |

*Primary Examiner*—P. W. Echols
*Assistant Examiner*—Adrian L. Coley

[57] ABSTRACT

A machine (46) for attaching an Insulation Displacement Connector (IDC) (10) to a cable (20) includes a fixture (76, 240) for engaging and arranging individual wires (18-18) in the cable in parallel, spaced-apart relationship. The machine also includes a press mechanism (51, 54, 101, 102)) for engaging a mandrel (12) of the IDC (10) and for pressing it against the wires (18-18) engaged by the fixture (76, 240) to seat each wire in a corresponding mandrel channel (14). The press mechanism (51, 54, 101 and 102) further functions to press the mandrel (12), with the wires (18-18) seated in the mandrel channels (14-14), against a IDC contact block (22) to engage each wire with an end (30) of a corresponding IDC contact (24) to accomplish attachment. As the wires (18-18) are pressed into the mandrel channels (14-14), a blade (106) severs the excess portion of each wire to facilitate attachment of the wires to the contacts.

17 Claims, 6 Drawing Sheets

METHOD AND APPARATUS FOR ATTACHING CONNECTORS

TECHNICAL FIELD

This invention relates to a method and an apparatus for attaching individual wires of a multi-conductor cable to individual contacts of an Insulation Displacement Connector.

BACKGROUND ART

Insulation Displacement Connectors (IDCs) are widely used in the electronics industry for electrically connecting the wires of a cable to the wires of another cable or to a piece of equipment. While IDCs vary widely in their design, all such connectors typically include one or more electrical contacts, each having a first end designed for making an electrical connection with a corresponding contact of a mating connector. The opposite end of each contact has a notch for receiving one of the wires of the cable terminated by the IDC. When a wire of the cable is pressed into the notch of a corresponding contact of the IDC, the notch displaces a portion of the insulation about the wire. In this way, the conductor within the wire makes an electrical connection with the contact. Thus, the need to strip or otherwise remove the insulation about each wire in the cable prior to attaching the IDC is eliminated.

Even though the IDC obviates the need to strip each wire prior to attachment, the process of attaching an IDC to a multi-conductor cable still can be tedious and time-consuming. For many types of IDCs, an operator must manually press each wire of the cable into the notch of a corresponding contact. Once each wire has been pressed into the notch of a corresponding contact, a portion of the wire often extends beyond the contact. Invariably, the portion of the wire extending beyond the contact is longer than necessary, giving rise to an "excess portion" of the wire that must be trimmed. For an IDC having a large number of contacts, trimming the excess portion of the wires can be tiresome.

Thus, there is a need for a process for accomplishing simplified attachment of the wires of a cable to the corresponding contacts of an IDC.

BRIEF SUMMARY OF THE INVENTION

Briefly, in accordance with a preferred embodiment, a technique is provided for attaching the wires of a multi-conductor cable to the corresponding contacts of an IDC. The process is initiated by arranging the wires in parallel, spaced-apart relationship. Next, a mandrel, having a plurality of spaced-apart wire-receiving channels is pressed against the wires of the cable to seat each wire in a corresponding channel in the periphery of the mandrel. At the same time the wires seat in the mandrel channels, the "excess portion" of each wire extending beyond the mandrel (i.e., that part of the wire extending beyond the mandrel exceeding a prescribed length) is trimmed. Thereafter, the mandrel, with the wires now pressed into its channels, is urged against the contacts of an IDC so the wires engage the notches in the corresponding contacts of the IDC at the same time. In this way, each wire makes an electrical connection with a corresponding contact.

The above-described method affords the advantage that the excess portion of each wire is trimmed at the same time the wire is attached to the IDC, thereby saving effort and time. Moreover, the wires are attached to their corresponding IDC contacts all at once, also saving effort and time.

DETAILED DESCRIPTION

Figure 1:
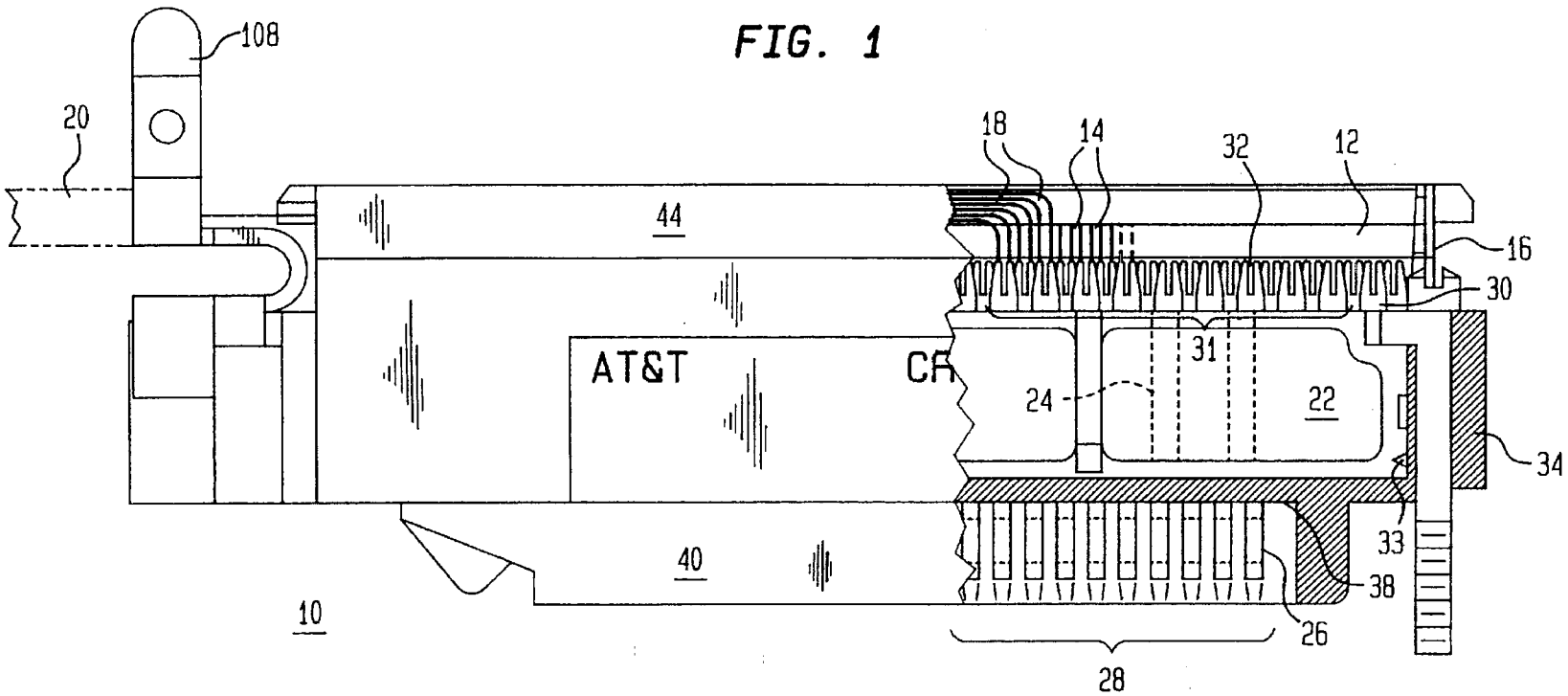
FIG. 1 is a side view, in cross section, of an IDC.

Before proceeding to discuss the attachment method and apparatus of the invention, reference should be made to FIG. 1 which illustrates an Insulation Displacement Connector (IDC) 10 suitable for practicing the invention. The IDC 10 of FIG. 1 comprises an elongated mandrel 12 formed of an insulative plastic block having a square or rectangular cross section. The mandrel 12 has a plurality of spaced-apart channels 14-14 at least partially circumscribing its periphery so each channel runs in a direction orthogonal to the mandrel major axis 16. Each channel 14 is dimensioned to at least partially seat one of the wires 18-18 of a cable 20 to be terminated by the IDC 10. In practice, the wires 18-18 are arranged in twisted pairs within the cable to enhance the transmission of data. Unfortunately, the twisted nature of the wires 18-18 complicates the attachment process.

The IDC 10 also includes an insulative block 22 that carries a plurality of electrically conductive contacts 24-24 (shown partially in phantom). Each contact 24 has a first end 26 lying in one of two spaced-apart rows 28-28 (only one row shown in FIG. 1) so the first contact ends in the rows are directly opposite each other for making an electrical connection with corresponding contacts (not shown) of a mating connector (not shown). Each contact 24 has a second end 30 opposite the first end 26. Like the first contact ends 26-26, the second contact ends are arranged in two spaced-apart rows 31-31 (only one shown). However, each second contact end 30 in each row 31 is staggered laterally from the second contact end in the other row. The second end 30 of each contact 24 has a notch 32 for displacing at least a portion of the insulation of one of the wires 18-18 pressed into the notch to expose the conductor (not shown) in the wire so the conductor makes an electrical connection with the contact.

The connector block 22 seats in a passage 33 of an insulative housing 34 so each first contact end 26 extends through an opening (not shown) in the housing bottom 38. A wall (not shown) extends along the housing bottom 38 to separate one row 28 of the first contact ends 26-26 from other the row. A skirt 40 extends from the bottom 38 of the housing 34 to circumscribe the first contact ends 26-26 for the purpose of aligning and mating the IDC 10 with a corresponding connector (not shown).

In addition to receiving the block 22, the housing 34 also receives the mandrel 12. As seen in FIG. 1, the mandrel 12 sits above the block 22 such that each mandrel channel lies in aligned registration with an individual first contact end 26. During attachment of the IDC 10 to the cable 20, the mandrel 12 is pressed into the housing 34 so each wire 18 in each mandrel channel 14 engages a notch 32 in a corresponding second first contact end 30. In engaging the wires 18-18 with the to the mandrel 12, it is desirable for wires to be engaged as close to the point at which the wires are twisted as possible. The IDC 10 further includes a plastic cover 44 that snaps onto the housing 34 to cover the mandrel 12 after the mandrel has been pressed into the housing as described.

Figure 2:
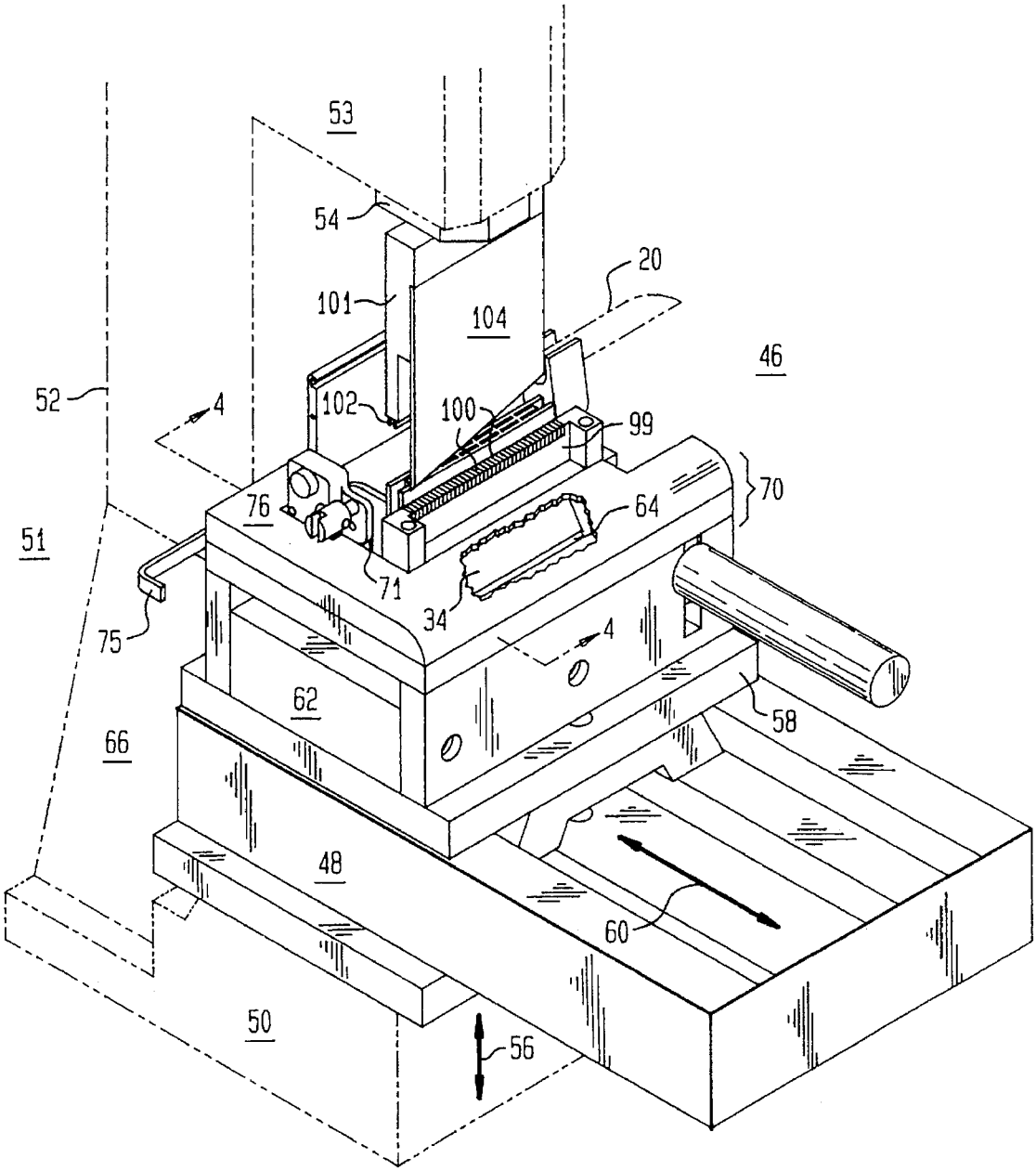
FIGS. 2 and 3 are left and right side views, in perspective, of a machine, in accordance with a first embodiment of the invention, for attaching the IDC of FIG. 1 to the wires of a multi-conductor cable.
Figure 3:
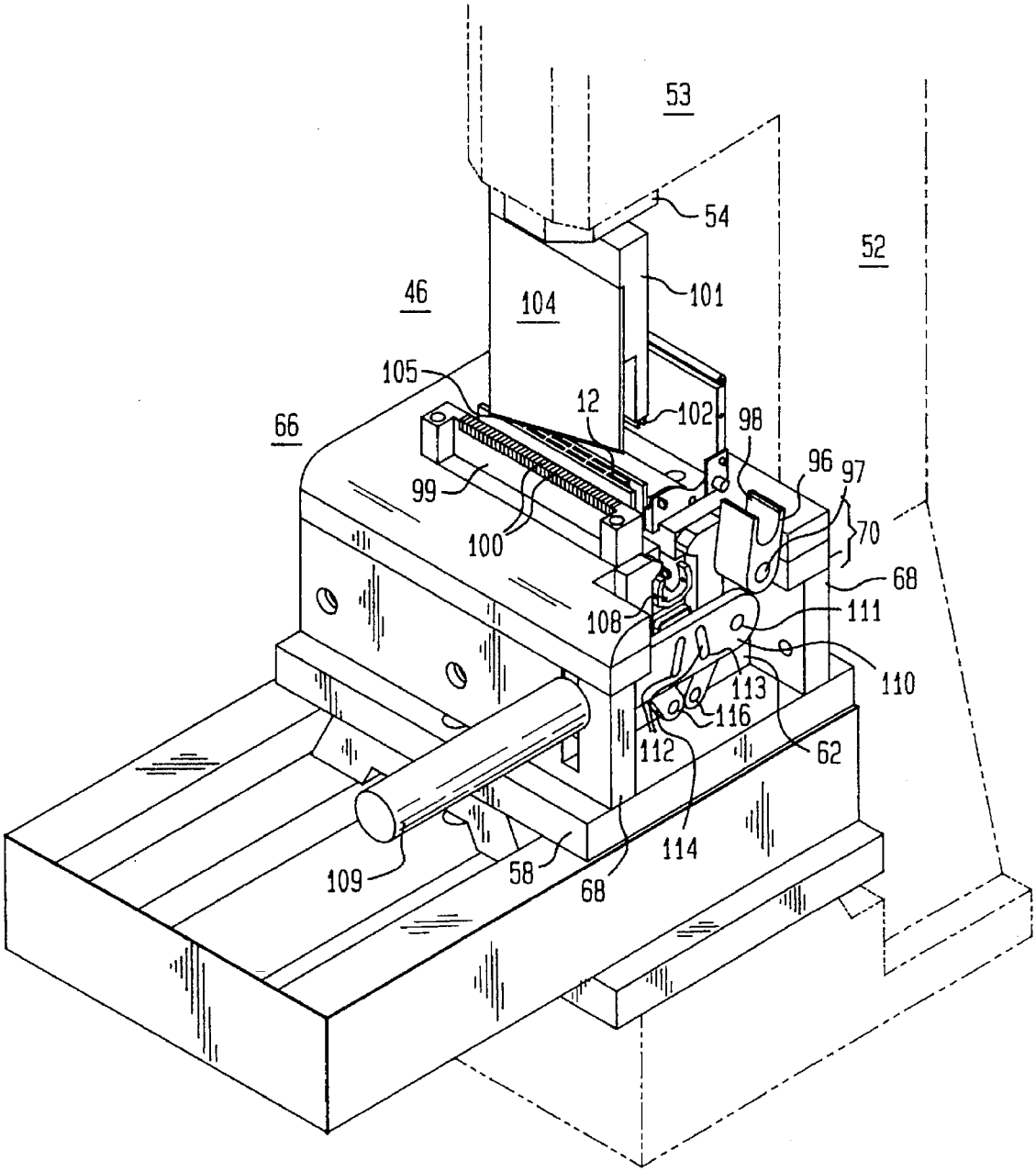

FIGS. 2 and 3 illustrate left and right side views, respectively, in perspective, of an assembly machine 46, in accordance with a first embodiment of the invention, for attaching the IDC 10 of FIG. 1 to the cable 20 of FIG. 1. The machine 46 comprises a base plate 48 secured to a bed 50 (see FIG. 2) of a press 51 (shown in phantom) that has an upwardly extending column 52 from which a head 53 extends horizontally to overlie the base plate 48. A spring-biased ram 54 is slidably mounted in the head 53 for reciprocation to and from the base plate 48 along a z axis 56 that extends normal to the plane of the base plate. A slide 58 is mounted to the base plate 48 of the machine 46 for reciprocation along a y axis 60 lying in the plane of the base plate and normal to the z axis 56. The slide 58 carries a member 62 that has an opening 64 (See FIG. 2)for receiving the IDC housing 34. The member 62 is straddled by a table 66 comprised of a pair of leg members 68-68 secured to opposite sides of the member. The leg members 68-68 support a table top 70 that overlies the member 62. The table top 70 has an opening 71 through which the IDC housing 34 (See FIG. 2) is exposed.

Figure 4:
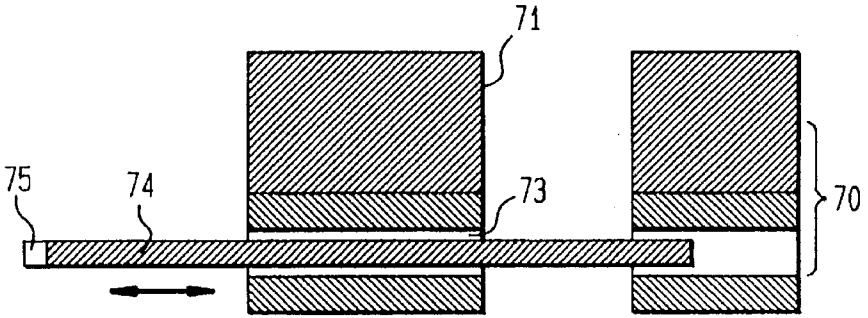
FIG. 4 is cross -sectional view of a portion of the machine of FIG. 2 taken along the plane 3—3.

Referring to FIG. 4, which shows an end view of the table top 70 in cross section taken along the plane 4—4 of FIG. 2, a passage 73 extends horizontally through at least a portion of the table top 70 in communication with the opening 71. A pressure plate 74, having an attached handle 75 (see FIG. 2), is slidably mounted within the passage 73 to close the opening 71 so that when closed, the opening only extends partially into the table top 70, rather than completely through the table top. By withdrawing the pressure plate 74 out from the passage 73, the opening 71 will extend fully through the table top 70.

Referring to FIG. 2, a wire preparation fixture 76 is releasably attached to the table top 70 adjacent to the opening 71. As will be discussed in greater detail hereinafter, the wire preparation fixture 76 secures the cable 20 (see FIG. 1) and maintains the exposed wires 18-18 (see FIG. 1) of the cable in parallel, spaced-apart relationship across the opening 71 to facilitate seating of the wires in the channels 14-14 (see FIG. 1) of the mandrel 12 (see FIGS. 1 and 3). As mentioned, the wires 18-18 in the cable 20 of FIG. 1 are arranged in twisted pairs. Without the presence of the wire preparation fixture 76 to hold the cable 20 and to maintain the wires 18-18 in parallel spaced relationship, it would be extremely difficult to attach the wires to the IDC 10 of FIG. 1.

Figure 5:
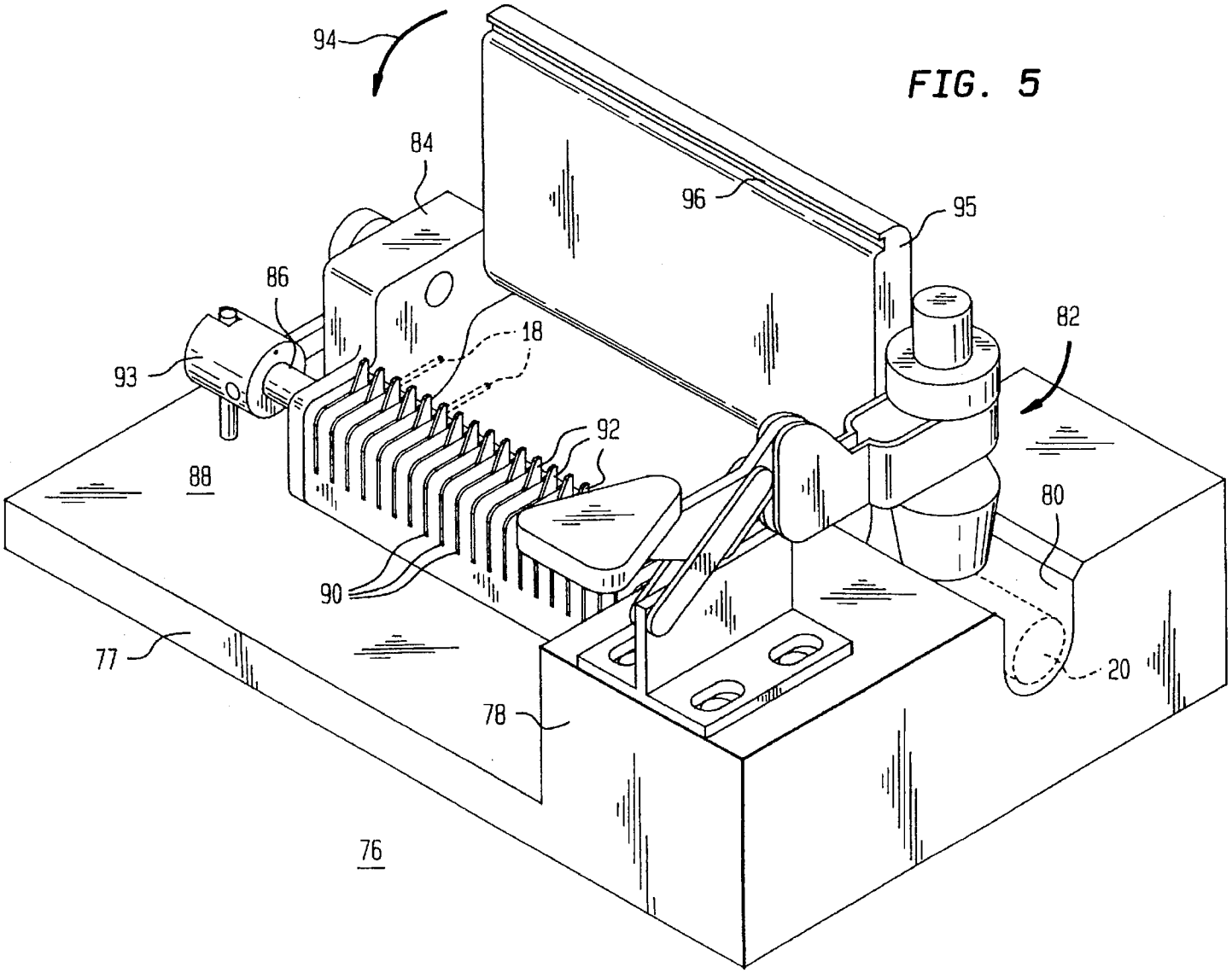
FIG. 5 is a right side view, in perspective, of a wire preparation fixture comprising part of the machine of FIG. 2.

The details of the wire preparation fixture 76 are best seen in FIG. 5. Referring to FIG. 5, the wire preparation fixture 76 comprises a plate 77 having a raised shoulder 78 that has a generally half-rounded channel 80 sized to seat a portion of the cable 20 shown in phantom. A cable-clamping mechanism 82 is secured to the top of the shoulder 78 for releasably clamping the cable 20 in the channel 80. In addition to the shoulder 78, the plate 76 has a pair of upwardly rising, spaced-apart walls 84 (only one shown) rising from its top surface for engaging opposite end portions of a pin 86. The pin 86 extends axially through a comb 88 having a plurality of spaced-apart slots 90-90, each slot seating an upwardly rising fin 92 engaged by the pin 86 so as to rotate therewith. The pin 86 may be locked in place via a locking collar 93 to maintain the fins 92-92 in their upward position as seen in FIG. 5. When the pin 86 is unlocked, then the pin can rotate, allowing the fins 92-92 to rotate, so each fin can descend into its corresponding slot 90.

The fixture 76 also includes a cover plate 95 hinged to each wall 84 for rotation. The cover plate 95 has a slot 96 running along its forward end (its upper end as seen in FIG. 5.) When the cover plate 95 is rotated to overlie the comb 88, each of the fins 92-92 extend into the slot 96. In this way, the cover plate 95 will lock the wires 18-18 (shown in phantom) in the comb against the fins 92-92.

Although the fixture 76 has been described as including the cable-clamping mechanism 82, the mechanism may be omitted. Referring to FIG. 3, a pawl 96, having a cable receiving notch 98, may be pivotally mounted to the table 70 for the purpose of supporting and retaining the cable 20 (see FIG. 1). The rotatable movement of the pawl 96 allows the cable 20 (see FIG. 1) seated in the notch 98 a limited degree of movement which may be desirable during attachment of the IDC 10 of FIG. 1

Referring to FIGS. 2 and 3, a comb 99 is attached to the table top 70 parallel to, and opposite from, the comb 88 (See FIG. 5) so that the combs are separated by a portion of the table opening 71 of FIG. 2. The comb 99 has a plurality of spaced-apart channels 100-100 at least partially circumscribing its periphery so each channel is aligned with a void between a pair of fins 92-92 of the comb 88 of FIG. 5. As will be discussed in greater detail, the comb 99 and the comb 88 collectively hold the wires 18-18 (sees FIGS. 1 and 5) in parallel, spaced-apart relationship across the table top opening 71 after the wires have been exposed and untwisted. In this way, the wires 18-18 are held below the ram 54.

As described, the pressure plate 74 and the comb 99 are associated with the table 70 rather than with the fixture 76. It may be desirable in some instances to configure the fixture 76 to incorporate these features. Under these circumstances, the base plate 77 of the fixture would necessarily include an opening (not shown) to allow the mandrel 12 of FIG. 1 to pass through the base plate for receipt in the IDC housing 34 of FIG. 1.

As seen in FIGS. 2 and 3, a combined punch and cut-off head 101 is mounted to the ram 54 of the press 51 to overlie the opening 71 in the table top 70. The head 101 has at least one depending finger 102 that engages the mandrel 12 so that a mandrel may be releasably carried for downward displacement when an operator actuates the ram 54 to displace the head 101 downward towards the opening 71 of FIG. 1. As the mandrel 12 descends towards the opening 71, the mandrel bears against the wires 18-18 (see FIG. 1) extending between the combs 88 and 99, thereby seating each wire in a corresponding mandrel channel 14 (see FIG. 1). To prevent the mandrel 12 from descending too far when the wires 18-18 are being seated in the mandrel channels 14-14, the pressure plate 74 is closed, sealing the opening 71.

In addition to the fingers 102, the head 101 also carries a guillotine blade 104 that is spaced forward (as seen in FIG. 2) from the fingers. The blade 104 has a sloped cutting edge 105 that extends across the head 101 parallel to the mandrel 12 when engaged by each finger 102. When head 101 descends, the blade 104 also descends, thereby severing the excess portion of each wire 18 (sees FIGS. 1 and 5), that is, the portion of each wire extending beyond the blade. The angled nature of the cutting edge 105 of the blade 104 allows the blade to sever the excess portion of the wires 18-18 in sequence as the blade descends. In this way, the required force to actuate the ram 54 is reduced.

Referring to FIG. 3, the machine 46 includes a mechanism 106 for attaching a strain relief 108 (see FIGS. 1 and 3), carried by the IDC housing 34 of FIG. 1, to the cable 20 of FIG. 1. The mechanism 106 includes a handle 109 having a flattened end 110 that extends through the forward (left-hand) table leg 68 for pivotal mounting to the member 62 by way of a pin 111. The flattened end 110 of the handle 109 has a pair of elongated openings 112-112 that slope upwardly. Each opening 112 receives a pin 113 extending into a separate one of a pair of jaws 114-114. Each jaw 114 is rotatably coupled at its lower end to the member 62 by one of a pair of pins 116-116 so the jaws lie on opposite sides of the strain relief 109 carded by the connector housing 34 of FIG. 1.

When the handle 109 is pushed downward, each pin 113 rides in each opening 112, causing the jaws 114-114 to move towards each other. As the jaws 114-114 move toward each other, the jaws squeeze the strain relief 108 against the cable 20 of FIG. 1. Once the strain relief 108 has been attached, the handle 109 is raised to separate the jaws 114-114.

The overall process by which the machine 46 attaches the wires 18-18 to the contacts 24-24 will now be described. At the outset of the attachment process, the operator slides the slide 58 forward to facilitate removal of the fixture 76 from the table 70 and loading of the IDC housing 34 (see FIG. 3) into the member 62. Once the operator has loaded the connector housing 34, the operator returns the fixture 76 to the table 70 and then places the cable 20 (see FIGS. 1 and 5) in the channel 80 after the cable has been stripped to expose the wires 18-18. The operator next untwists the pairs of wires 18-18 and places each wire between a corresponding pair of fins 92-92 in the fixture comb 88 of FIG. 5 and thereafter locks the wires in place by rotating the cover plate 95 of FIG. 5 onto the fins 92-92. At this time, the pin 86 of FIG. 5 is locked against movement, preventing the fins 92-92 from rotating. The comb 88 advantageously holds the wires 18-18 so that the wires 18-18 remain twisted in pairs with the exception of the short length extending beyond the comb for attachment to the mandrel 12. In this way, the untwisted length of each wire 18 is minimized which is very advantageous.

After locking the wires 18-18 of FIGS. 1 and 5 in place, the operator places each wire in a corresponding channel 100 in the comb 99. Next, the operator loads the mandrel 12 in the head 101 and thereafter displaces the slide 58 rearward to locate the table opening 71 below the head 101. The operator next actuates the ram 54 to displace the ram 54 and the head 101 downward, thereby seating the wires 18-18 (see FIG. 1) in the mandrel channels 14-14 of FIG. 1. At this time, the pin 86 of FIG. 5 is unlocked, thereby allowing the fins 92-92 to rotate to permit the wires 18-18 to move as they seat in the mandrel channels 14-14. At the same time, the blade 106 trims the excess portion of the wires 18-18.

Once the wires 18-18 have been pressed into the mandrel channels 14-14 and simultaneously timed, the operator displaces the pressure plate 74 away from the opening 71 in the table top 70 to allow the head 101 to pass through the opening. The operator now actuates the ram 54 to further displace the head 100 downward, thereby urging the mandrel 12 into the housing 34. As the head 101 urges the mandrel 12 into the housing 34, the wires 18-18 in the mandrel channels 14-14 engage the corresponding second ends 30-30 (see FIG. 1) of the contacts 24-24 of FIG. 1. At this point, the attachment process is essentially completed, whereupon, the operator allows the ram 54 and the head 101 to ascend.

After the mandrel 12 seats in the IDC housing 34 to engage the wires 18-18 with the second contact ends 30-30, the operator cinches the strain relief 108 about the cable 20 in the manner previously described. Finally, the operator slides the slide 58 forward and thereafter removes the fixture 76 to allow the IDC housing 34 to be removed.

As may be appreciated, the machine 46 affords the advantage of simplified IDC attachment. The machine 46 not only seats the wires 18-18 in the mandrel channels 14-14 simultaneously, but also trims the wires at the same time. Moreover, the machine 46 attaches the wires 18-18 to the contact first ends 28-28 in a unified manner. Also, as discussed, the machine 46 minimizes the untwisted length of the wires 18-18 upon attachment to the IDC, a distinct advantage.

In connection with the machine 46, it may be desirable to provide a plurality of individual wire preparation fixtures 76, rather than the single fixture described. In practice, the time required to arrange the wires 18-18 in parallel, spaced relationship is greater than the amount of time required to press the mandrel 12 into the wires and then to press the mandrel into the IDC housing 34. Thus, by providing multiple wire preparation fixtures 76, the fixtures could be cycled between several operators and a single machine 46, thereby maximizing machine productivity.

Figure 6:
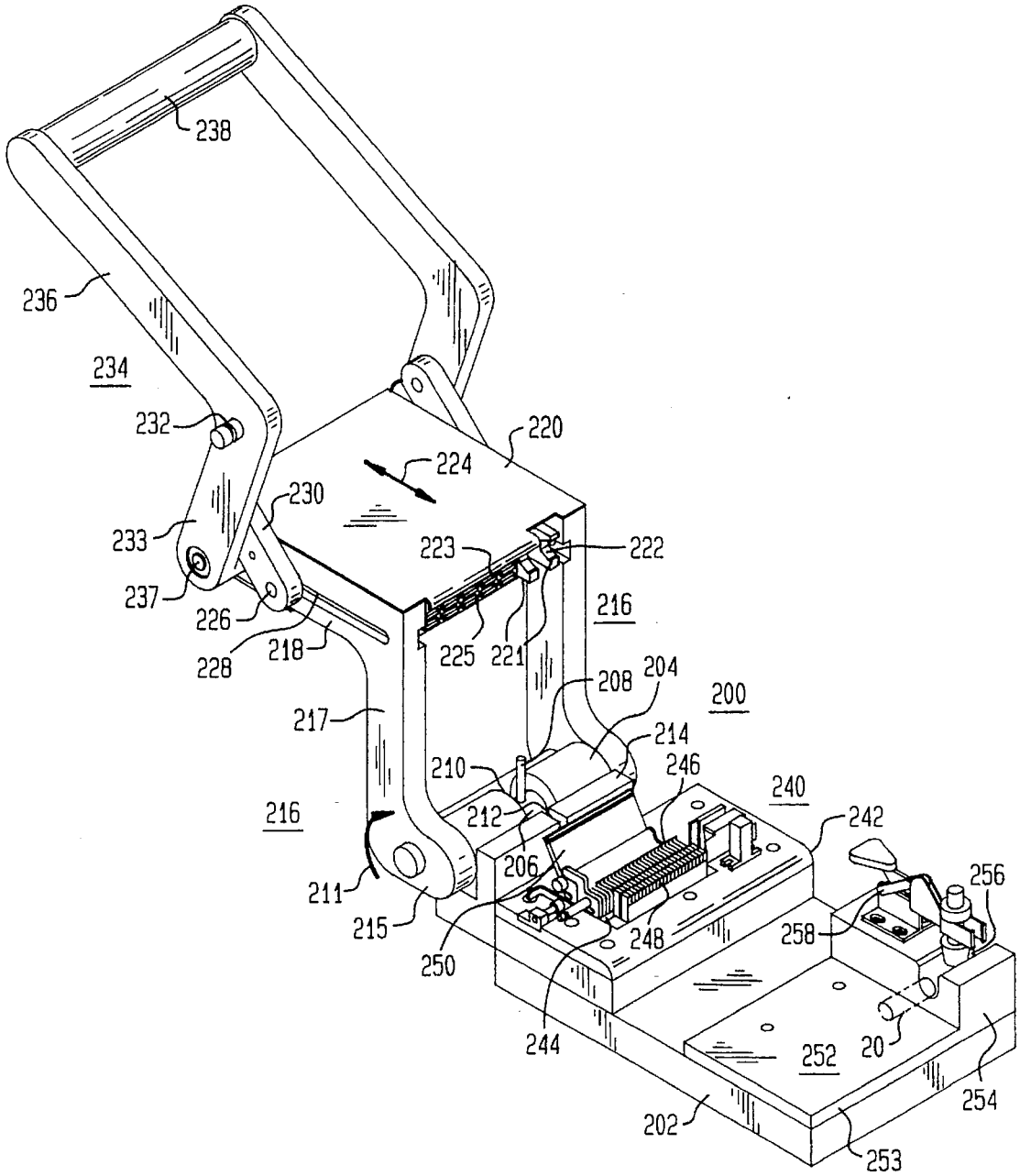
FIG. 6 is a left side view, in perspective, of a machine, in accordance with a second embodiment of the invention, for attaching the IDC of FIG. 1 to a multi-conductor cable.

FIG. 6 illustrates a left side view, in perspective, of a machine 200, in accordance with a second preferred embodiment, for attaching the IDC 10 of FIG. 1 to the cable 20 of FIGS. 1 and 5 in a manner similar to that described above for the machine 46 of FIGS. 2 and 3. The machine 200 of FIG. 6 comprises a base plate 202 having a horizontally-extending pintle 204 at its rearward end (as seen in FIG. 6). The pintle 204 rotatably journals a pin 206 having a finger 208 extending normal from the pin through an opening 210 in the pintle. Upon clockwise rotation of the pin 206 about an arc 211, the finger 208 engages a channel 212 in a block 214 secured to the end of the base plate 202 forward of the pintle 204. In this way, the rotation of the pin 206 is limited.

The pin 206 has each end (not shown) secured to a horizontal portion 215 of each of a pair of "L"-shaped arms 216-216. Each arm 216 has a vertical portion 217 provided with an integral, perpendicular web 218. The webs 218-218 secure opposite ends of a plate 220 having a pair of laterally spaced fingers 221-221 each having a notch 222 in its forward end. As will become better understood hereinafter, the fingers 221-221 act to retain the cable 20 of FIG. 1 during attachment of the IDC 10.

In addition to the fingers 221-221, the plate 220 carries a nest 223 slidably mounted for movement along an axis 224 parallel to the webs 218-218. The nest 224 has at least one extending finger 225 for engaging the mandrel 12 of FIG. 1. Spaced from the finger 225 is a blade (not shown) similar to the blade 104 of FIGS. 2 and 3 for severing the excess portion of the wires 18-18 of FIG. 1 when the mandrel 12 of FIG. 1 is pressed into the IDC housing 34 in the manner described hereinafter.

The nest 223 carries a bar 226 that extends through an elongated opening 228 in each of the webs 218-218 for receipt in one end of each of a pair of links 230-230. Each link 230 has its opposite end rotatably journaled via a dowel 232 to a base portion 233 of one of a pair of "L"-shaped arms 234-234, each arm having an upper portion 236 joined to the upper portion of the other arm by a handle 238. Each arm 234 also has its base portion 233 rotatably journaled to each web 218 via a pin 237. In this way, as the arms 236 are rotated forward (as seen in FIG. 6), the pin 226 moves forward, displacing the nest 223 forward in FIG. 6.

Figure 7:
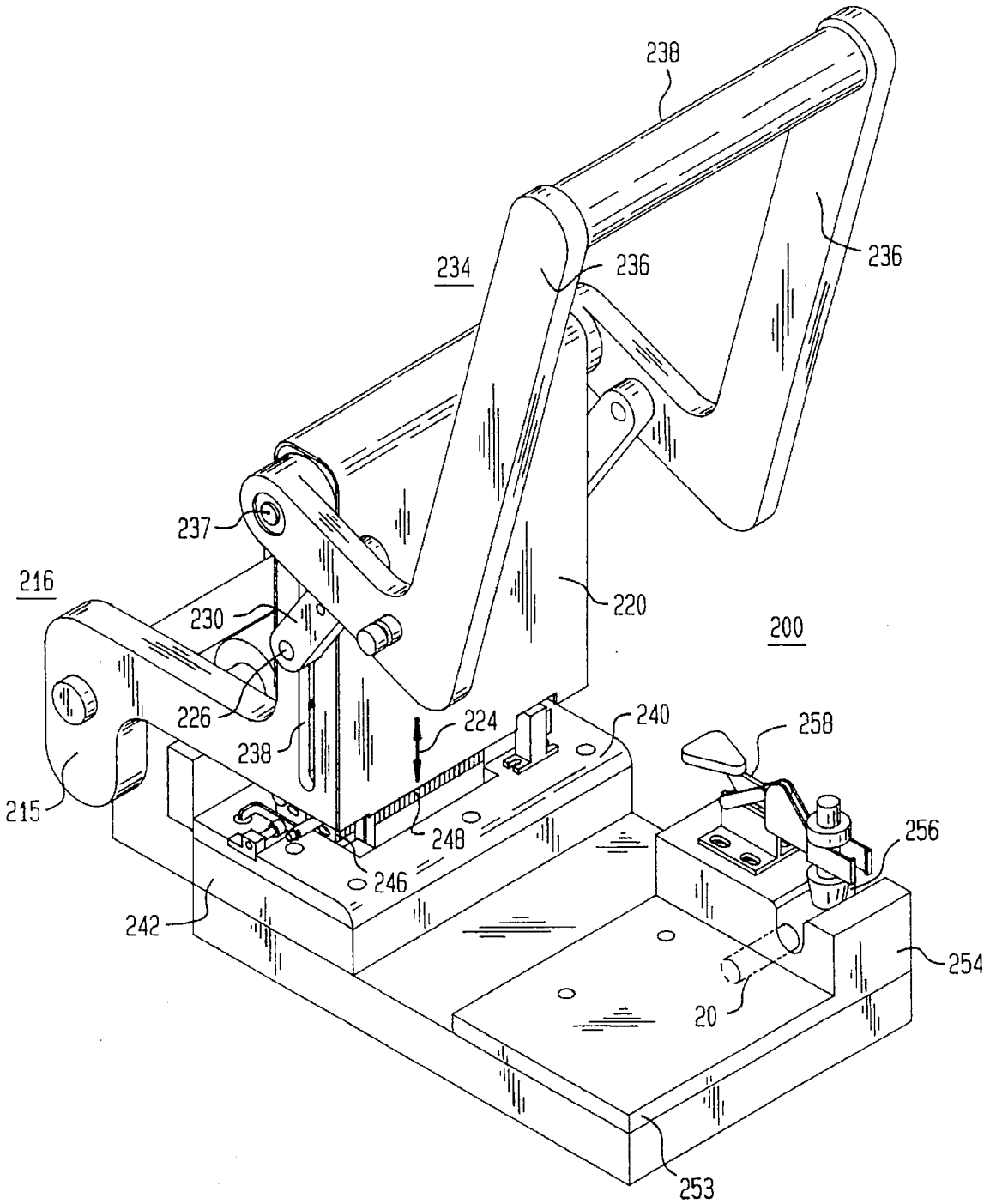
FIG. 7 is a left side view, in perspective, of the machine of FIG. 4 showing the machine in a closed position.

When the arms 216-216 are rotated to their fully forward position as seen in FIG. 7, the nest 223 of FIG. 6 overlies a wire retention fixture 240 having a construction similar to the fixture 76 of FIG. 5. The fixture 240 comprises a plate 242 removably attached to the base plate 202. The plate 242 has an opening 244 lying in aligned registration with the nest 223 with an opening (not shown) in the base plate 202 that is sized to receive the IDC housing 34 of FIG. 1. Both the opening 244 and the IDC housing opening in the plate 202 are positioned to He in aligned registration with the nest 223 when the arms 216-216 are rotated as shown in FIG. 7.

The plate 242 further includes a slidable pressure plate (not shown) similar to the plate 74 of FIG. 3 for slidable movement into and out of a horizontal passage (not shown) in the plate 242 in communication with the opening 244. In this way, the opening 244 may be closed to limit the penetration of the mandrel 12 (see FIG. 1) into the opening.

The fixture 240 includes a pair of combs 246 and 248 configured the same as the combs 88 and 99, respectively of FIG. 2. The combs 246 and 248 hold the wires 18-18 of FIG. 1 in parallel, spaced-apart relationship across the opening 244 in much the same way that the combs 88 and 99 hold the wires across the opening 71 of FIG. 2. In addition, like the cover plate 95 of the fixture 76 of FIG. 5, the fixture 240 of FIG. 6 includes a rotatable cover plate 250 for locking the wires 18-18 of FIG. 1.

Lastly, the base plate 202 mounts a cable retainer 252 comprised of a plate 253 having a raised shoulder 254 that has a half-circular channel 256 extending thereacross (from right to left in FIG. 6) for receiving the cable 20. A cable-clamping mechanism 258, of a construction substantially similar to the cable clamping mechanism 82 of FIG. 2, is secured to the top of, the shoulder 254 to clamp the cable 20 of FIG. 1 in the channel 256 to allow the free end of the cable to be looped and thereafter fed into the wire retainer 240.

The tool 200 operates in the following manner. Initially, an operator rotates the arms 216-216 to open the tool as seen in FIG. 6. With the tool 200 in its open position, the operator first removes the fixture 240 and then places the IDC housing 34 (see FIG. 1) in the base plate 202. Thereafter, the operator replaces the fixture 240 and clamps the cable 20 so that its free end, having been previously stripped of its outer sheath, may be looped to allow the exposed wires 18-18 (see FIG. 1) to reach the fixture 240 for engagement in the combs 246 and 248. Next, the operator engages the wires 18-18 in the combs 246 and 248 to arrange the wires in parallel, spaced-apart relationship across the opening 244 to minimize the length of the untwisted portion of each wire.

Once the wires 18-18 are engaged, the operator loads the mandrel 12 of FIG. 1 in the nest 223 so the mandrel engages each finger 225. (Note that the operator could have loaded the mandrel 12 prior to engaging the wires 18-18 in the combs 246 and 248.) After loading the mandrel 12 in the nest, the operator effectively closes the opening 244 by sliding the pressure plate into the plate if the opening has not been previously closed.

Now, the operator is ready to seat the wires 18-18 of FIG. 1 in the mandrel channels 14-14 of FIG. 1. To do so, the operator grabs the handle 238 to rotate the arms 216-216 forward to close the tool as seen in FIG. 7. As the operator closes the tool 200, the operator urges the mandrel 12 of FIG. 1, carried in the nest 223 of FIG. 6, into engagement with the wires 18-18 of FIG. 1 to seat each wire in a corresponding mandrel channel 14 of FIG. 1.

As discussed earlier, the forward motion of the arms 216-216 is limited by the finger 208 of FIG. 5. Thus, once the finger 208 of FIG. 5 engages the slot 212, the arms 216-216 can no longer rotate in the forward direction so the mandrel 12 descends no further against the wires 18-18. At this time, the operator exposes the IDC housing 34 of FIG. 1 in the base plate 202 by withdrawing the pressure plate away from the opening 244. With the IDC housing 34 exposed, the operator exerts a downward pressure on the handle 238 to rotate the arms 234-234 forward. The forward rotation of the arms 234-234 now displaces the nest 223 of FIG. 6 downward, driving the mandrel 12 into the IDC housing 34 to engage each wire 18 with a corresponding notch 32 in a second contact 30. At the same time, the excess portion of each wire 18 is severed by the blade spaced from the nest. Finally, the operator rotates the arms 234-234 and 216-216 rearward, to allow removal of the fixture 240 and the IDC housing 34 with its now-seated mandrel 12.

The foregoing describes a method and apparatus for attaching an IDC 10 to a cable 20.

It is to be understood that the above-described embodiments are merely illustrative of the principles of the invention. Various modifications and changes may be made thereto by those skilled in the art which will embody the principles of the invention and fall within the spirit and scope thereof.

What is claimed is:

1. A method for attaching individual wires of an IDC to a cable, the IDC including a mandrel having a plurality of spaced-apart, wire-receiving channels about its periphery, and a contact block containing a plurality of spaced-apart contacts, each having an end provided with a notch for engaging a wire, the method comprising the steps of:

arranging the wires in generally parallel, spaced- apart relationship;

pressing the mandrel against the wires of the cable, which have been arranged in parallel, spaced-apart relationship, to at least partially seat each wire in a corresponding mandrel channel;

trimming an excess portion of each wire extending beyond a prescribed distance from the mandrel as the mandrel is pressed against the wires; and pressing the mandrel, with the wires at least partially seated in the mandrel channels, against the contact block to engage each wire in a mandrel channel in a notch in a first contact end of a corresponding contact.

2. The method according to claim 1 wherein the wires are arranged in parallel, spaced-apart relationship by the steps of:

engaging each wire in a corresponding one of a plurality of spaced-apart, wire-engaging slots in a pair of spaced-apart combs; and releasably locking the wires to at least one of the combs.

3. The method according to claim 2, wherein the step of pressing the mandrel against the wires of the cable comprises pressing the mandrel through a space between the pair of spaced-apart combs.

4. The method according to claim 2, wherein the step of releasably locking the wires to at least one of the combs comprises closing a cover plate over one of the combs so that the cover plate bears against the wires seated in the comb.

5. The method according to claim 1 wherein the trimming step comprises the step of displacing a blade against the excess portion of the wires as the mandrel is pressed against the wires.

6. The method according to claim 5 wherein each the excess portion of each wire is trimmed in sequence by the blade.

7. Apparatus for attaching individual wires of an DC to a cable, the DC including a mandrel having a plurality of spaced-apart, wire-receiving channels about its periphery, and a contact block containing a plurality of spaced-apart contacts, each having an end provided with a notch for engaging a wire, the apparatus comprising:

means for aging the wires in generally parallel, spaced-apart relationship;

means in operative relationship with the means for -arranging for pressing the mandrel against the wires of the cable arranged in parallel, spaced-apart relationship to at least partially seat each wire in a corresponding mandrel channel and for pressing the mandrel, with the wires at least partially seated in the mandrel channels, against the contact block to engage each wire in a mandrel channel in a notch in a first contact end of a corresponding contact; and means, carried by the pressing means, for trimming an excess portion of each wire extending beyond a prescribed distance from the mandrel as the mandrel is pressed against the wires.

8. The apparatus according to claim 7, wherein the means for arranging the wires in parallel, spaced-apart relationship comprises:

a plate;

first and second combs mounted to the plate in parallel, spaced-apart relationship so that the mandrel can pass between the first and second combs as it is pressed against the wires of the cable, each comb having a plurality of spaced wire-receiving slots arranged so that each slot in the first comb lies in aligned relationship with a corresponding slot of the second comb; and means for releasably locking the wires to the first comb.

9. The apparatus according to claim 8 wherein the arranging means further includes a cable-clamping mechanism mounted to the plate for releasably clamping the cable.

10. The apparatus according to claim 7 wherein the pressing means comprises:

a press having a ram mounted for reciprocal movement to and from the means for arranging the wires;

a head carried by the ram;

means on the head for engaging the mandrel.

11. The apparatus according to claim 10 wherein the trimming means comprises a blade carried by the head in spaced relationship from the means for engaging the mandrel.

12. The apparatus according to claim 11 wherein the blade comprises a guillotine blade having an angled cutting edge.

13. The apparatus according to claim 7 wherein the means for pressing comprises:

a first rotatable assembly having a movable nest for releasably engaging the mandrel, the first rotatable assembly being rotatable between a first position at which the nest is distant from the means for arranging and a second position at which the nest overlies the means for arranging, so that the mandrel, when engaged in the nest, engages the wires arranged by the means for arranging so each wire at least partially seats in a channel in the mandrel;

means for limiting the rotation of the first rotatable assembly to prevent its rotation beyond the second position; and a second rotatable assembly coupled to the first rotatable assembly for displacing the nest once the first rotatable assembly rotates to its second position to urge the mandrel against the contact block to engage each wire in each wire-receiving channel of the mandrel with each notch in each corresponding contact end of each contact.

14. The apparatus according to claim 13 wherein the first rotatable assembly comprises:

a base plate having a horizontal pin-receiving pintle;

first and second arms;

a pin extending through the pintle and rotatably journaled at each of its ends to each of the first and second arms, respectively, to rotatably journal the arms to the base plate; and a plate joining the arms and slidably mounting the nest.

15. The apparatus according to claim 14 wherein the means for limiting rotation comprises:

a finger extending from the pin through the pintle; and a stop mounted to the base plate for receiving the finger once the arms have rotated to a prescribed position.

16. The apparatus according to claim 14 wherein the second rotatable assembly comprises:

third and fourth arms rotatably journaled to opposite ends of the plate;

a handle joining the third and fourth arms;

a bar joined to the nest slidably mounted to the plate; and first and second links joined to opposite ends of the bar, each link being rotatably coupled to each of the third and fourth arms, respectively, for displacing the bar and the nest within the plate upon rotation of the third and fourth arms.

17. The apparatus of claim 7, further comprising a means for clamping a strain relief collar around the cable.

* * * * *